US005244075A

United States Patent [19]

Obara et al.

[11] Patent Number: 5,244,075

[45] Date of Patent: Sep. 14, 1993

[54] CIGARETTE EJECTING APPARATUS OF A CIGARETTE PACKAGING APPARATUS

[75] Inventors: Koichiro Obara; Tadao Etani, both of Tokyo, Japan

[73] Assignee: Japan Tobacco Inc., Tokyo, Japan

[21] Appl. No.: 878,992

[22] Filed: May 6, 1992

[30] Foreign Application Priority Data

May 8, 1991 [JP] Japan ..... 3-102851

[51] Int. Cl.[5] ..... B65G 47/46

[52] U.S. Cl. ..... 198/372; 198/418.3; 53/54; 53/494; 53/149; 131/282

[58] Field of Search ..... 198/370, 372, 418.3, 198/438, 493; 53/54, 494, 149-151; 131/282, 283

[56] References Cited

U.S. PATENT DOCUMENTS

| | | | |
|---|---|---|---|
| 3,543,927 | 12/1970 | Pinkham et al. | 209/537 |
| 3,603,445 | 9/1971 | Zausch et al. | 198/418.3 |
| 4,452,255 | 6/1984 | Brand | 198/438 |
| 4,511,045 | 4/1985 | Seragnoli | 53/54 |
| 4,607,477 | 8/1986 | Hinchcliffe et al. | 53/54 |
| 4,614,263 | 9/1986 | Nagata et al. . | |
| 4,711,339 | 12/1987 | Nagata et al. . | |
| 4,901,860 | 2/1990 | Wahle et al. | 209/535 |

FOREIGN PATENT DOCUMENTS

| | | | |
|---|---|---|---|
| 0134590 | 3/1985 | European Pat. Off. . | |
| 2327916 | 12/1973 | Fed. Rep. of Germany | 53/151 |
| 2073576 | 10/1981 | United Kingdom . | |
| 2098971 | 12/1982 | United Kingdom . | |

*Primary Examiner*—Joseph E. Valenza

[57] ABSTRACT

A piling machine of a cigarette packaging apparatus comprises a number of transferring drums disposed between the respective aligning drums of the apparatus for aligning a given number of cigarettes in rows and the piling drum for piling rows of cigarettes into layers in an orderly and staggered manner in the cigarette packaging apparatus. The transferring drums are provided with suction nozzles and ejection nozzles so that the system is capable of holding cigarettes coming from the aligning drums to the transferring drums by negative pressure in the suction nozzles and ejecting the cigarettes on any of the transferring drums of the apparatus by applying compressed air through the ejection nozzles whenever one or more than one defective cigarettes are detected in the row of cigarettes on any of the transfer ring drums or when the row of cigarettes on the transferring drum contains an insufficient number of cigarettes.

3 Claims, 8 Drawing Sheets

CIGARETTE EJECTING APPARATUS OF A CIGARETTE PACKAGING APPARATUS

BACKGROUND OF THE INVENTION

1. Field of the Invention

This invention relates to a cigarette ejecting system to be suitably used with a cigarette packaging apparatus. More particularly, it relates to a cigarette ejecting system to be incorporated in a cigarette packaging apparatus in which the system is realized by arranging transferring drums between the respective aligning drums of the apparatus for aligning a given number of cigarettes in rows and the piling drum for piling rows of cigarettes into layers in an orderly and staggered manner in the cigarette packaging apparatus so that the system is capable of ejecting the cigarettes on any of the transferring drums of the apparatus by applying compressed air whenever one or more than one defective cigarettes are detected in the row of cigarettes on any of the transferring drums or the row of cigarettes on the transferring drum contains an insufficient number of cigarettes.

2. Description of the Related Art

A cigarette packaging apparatus normally comprises a piling machine that takes out a predetermined number of cigarettes, e.g., twenty cigarettes, out of a storage facility such as a hopper where cigarettes are randomly stored and piles them to three layers of seven, six and seven in an orderly and staggered manner, a wrapping machine that wraps them with a sheet of aluminum foil or a wrapping paper and a sealing machine that seals the wrapped package of cigarettes by an appropriate means (a sealing sheet). These machines are mutually connected as integral components of a cigarette packaging apparatus so that cigarettes fed to the hopper are discharged from the packaging apparatus in the form of packaged final products.

The piling machine is provided with a number of cigarette feed channels that correspond to the number of cigarettes to be packed together in a package (e.g., twenty channels) and the cigarettes in the hopper are aligned in the channels and gradually fed to the machine. The piling machine takes up a cigarette from each channel at a time by means of a receiving drum. The cigarettes held by the respective drums are then transferred to three aligning drums, which carry respectively seven, six and seven aligned cigarettes for three layers of cigarettes. The cigarettes on the aligning drums are thereafter moved to a piling drum that receives the three different rows of cigarettes from the respective aligning drums to form on it three layers of cigarettes arranged in an orderly and staggered manner for a package of twenty cigarettes. Finally, the piled cigarettes are moved to the wrapping machine, where they are wrapped and sealed.

However, there may arise cases where defective cigarettes that may be devoid of a filter are fed to the aligning drums of the piling machine or where some of the cigarettes being fed are damaged while moving, leading to an insufficient number of flawless cigarettes arranged on one or more than one of the aligning drums. Packages of cigarettes that contain such defective cigarettes are, by definition, defective packages of cigarettes.

Conventionally, defective cigarettes are detected by means of a detector and ejected out of the transfer line somewhere in the wrapping machine by an appropriate means such as a pusher before they are packaged. However, any known means for ejecting defective cigarettes such as a pusher comprises a reciprocating mechanism and inevitably involves reciprocal movements, meaning that such a pusher or a similar means for ejecting defective cigarettes does not and cannot meet the requirement of high speed operation if an advanced cigarette packaging apparatus of recent development is used and inevitably imposes a speed limit to the operation of the apparatus.

Additionally, with a conventional cigarette packaging apparatus, defective cigarettes are ejected after having been wrapped by wrapping paper or foil and the tobacco of the defective cigarettes are separated from the wrapping paper and the casing for reuse, entailing cumbersome processes for the separation of tobacco and wrapping paper.

SUMMARY OF THE INVENTION

In view of the above circumstances, it is therefore an object of the present invention to provide a cigarette ejecting system to be incorporated in a cigarette packaging apparatus which is capable of ejecting defective cigarettes or cigarettes of rows that contain only an insufficient number of cigarettes before they are packaged.

According to the invention, the above object is achieved by providing a cigarette ejecting system realized by arranging a transferring drum between each of the aligning drums in the apparatus for aligning cigarettes in rows and the piling drum for piling rows of cigarettes in the cigarette packaging apparatus. The rows of cigarettes formed on the aligning drums of the apparatus are temporarily moved to the respective transferring drums and then further forwarded to the piling drum. Each of the transferring drums is provided on its outer peripheral surface with a number of groups of holding grooves, which are by turn provided at the bottoms with a set of open ends of a number of suction nozzles and that of a number of ejection nozzles. Each of the transferring drums is additionally provided o its inner peripheral surface with a stationary sleeve with a narrow clearance therebetween so that the transferring drum is rotatable around the sleeve while maintaining an airtight condition in the inside. The stationary sleeve is provided on its outer peripheral surface with a suction groove and an ejection groove. The suction groove is in communication with the suction nozzles. The ejection groove on the outer peripheral surface of the stationary sleeve is, on the other hand, in communication with the ejection nozzles.

Said suction nozzles are put under negative pressure by way of said suction groove to firmly hold the cigarettes arranged in the respective holding grooves. When one or more than one defective cigarettes or an insufficient number of cigarettes are sent there, compressed air is supplied to the ejection groove to burst forth through the groove to eject a row of cigarettes held there. In a preferred embodiment of the invention, a receiving shoot is arranged near each of the transferring drum to collect the ejected cigarettes.

Since a cigarette ejecting system according to the invention does not involve any reciprocal movement, it accommodates an high speed operation of the cigarette packaging apparatus where it is incorporated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
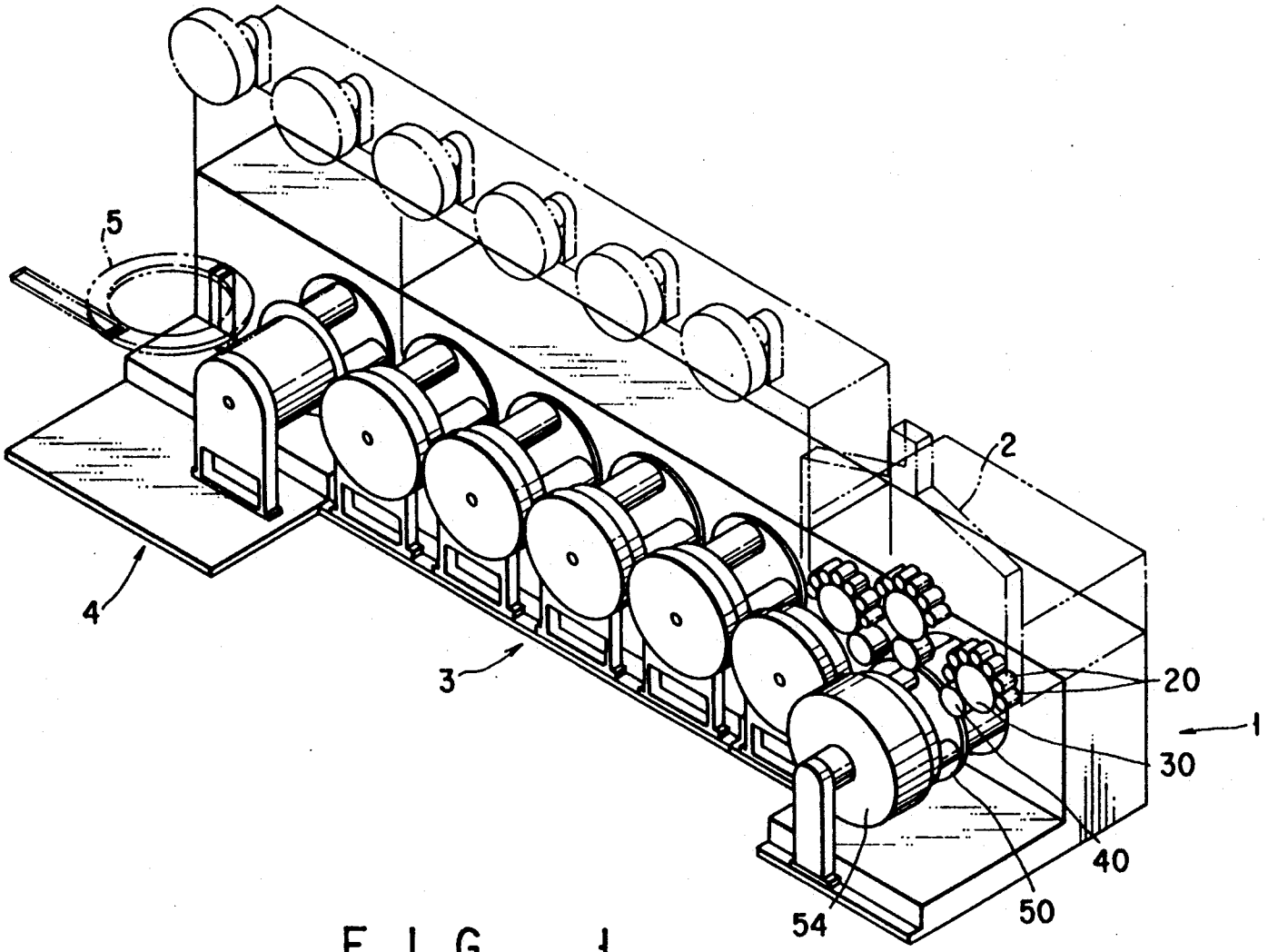
FIG. 1 is a schematic perspective view of a cigarette packaging apparatus incorporating a cigarette ejecting system according to the invention.

Now, the present invention will be described in greater detail by way of a preferred embodiment. FIG. 1 shows a schematic perspective view of a cigarette packaging apparatus incorporating a cigarette ejecting system according to the invention. The apparatus is designed to produce packages of twenty cigarettes. In FIG. 1, reference numeral 1 denotes a piling machine provided with a hopper 2 for receiving and temporarily storing a large number of cigarettes fed from a cigarette manufacturing machine of a known type (not shown). The piling machine picks up twenty cigarettes from the hopper at a time to produce three rows of seven, six and seven cigarettes, which are then piled up one on the other in an orderly and staggered manner to form three layers of cigarettes for a package.

The piled layers of cigarettes are then moved to a wrapping machine 3, which automatically wraps the package full of cigarettes by a sheet of aluminum foil or wrapping paper.

The wrapped cigarettes are then sealed by a sealing machine located adjacent to the wrapping machine 3 and discharged from the apparatus by way of a discharge conveyor 5.

Figure 2:
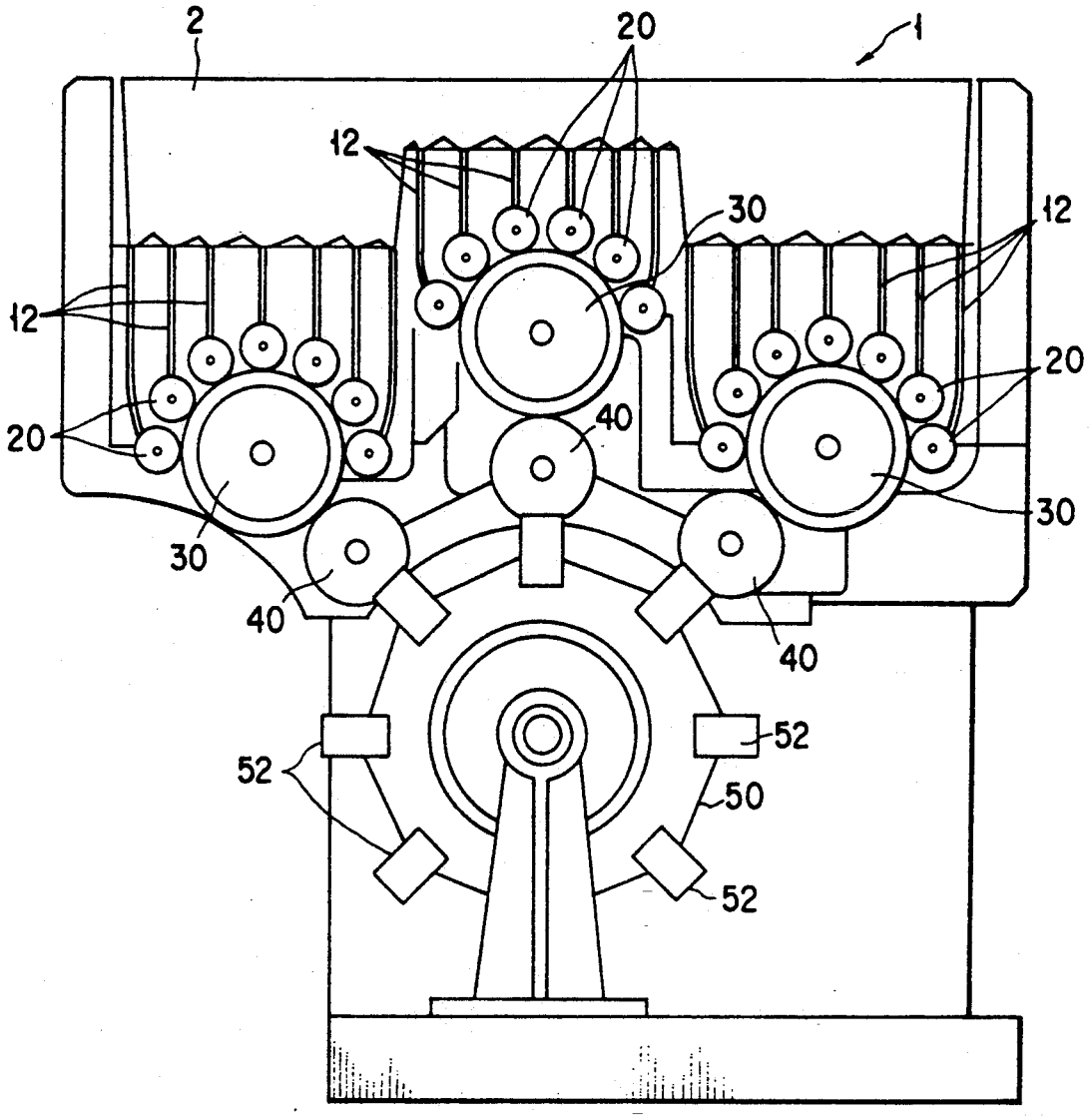
FIG. 2 is a front view of the piling machine of the apparatus of FIG. 1.

The piling machine 1 will now be described in greater detail by referring to FIGS. 2 through 5. As shown in FIG. 2, the hopper 2 is provided at its bottom with a total of twenty cigarette feed channels 12 running vertically. As clearly seen from FIG. 4, each of the channels 12 is defined by a pair of blocks 13 and 14 and each has a width slightly greater than the diameter of a cigarette C.

Said blocks 13 and 14 are provided on the upper surfaces with a pair of respective guide blocks 18, each having a ridge and lateral slopes. Each of the feed channels 12 is provided at the upper end, or the inlet port, with a pair of agitator rollers 11. These agitator rollers 11 are oscillated while being rotated in order to smoothly introduce cigarettes C into the feed channel 12 for which they are responsible from the hopper 2. Thus, the cigarettes C stored in the hopper 2 are gradually guided by the guide blocks 18 and moved into the feed channels 12 by way of the agitator rollers 11 on a one by one basis so that they are aligned in the feed channels 12. The cigarettes C in feed channels 12 moves downward by their own weight.

On the other hand, each of the feed channels 12 is provided at the lower end, or the outlet port, with a holder block 19, which in turn has at the lower end a flange 15 projecting substantially horizontally toward the feed channel 12. The flange 15 is provided at a lateral end with an open end of a negative pressure nozzle 16 which is in communication with a negative pressure pathway 17. Thus, the cigarettes C coming down through each of the feed channels 12 eventually abut the flange 15 and the lowermost cigarette C is held there for a certain period of time as it is sucked by the negative pressure of the negative pressure nozzle 16.

Figure 4:
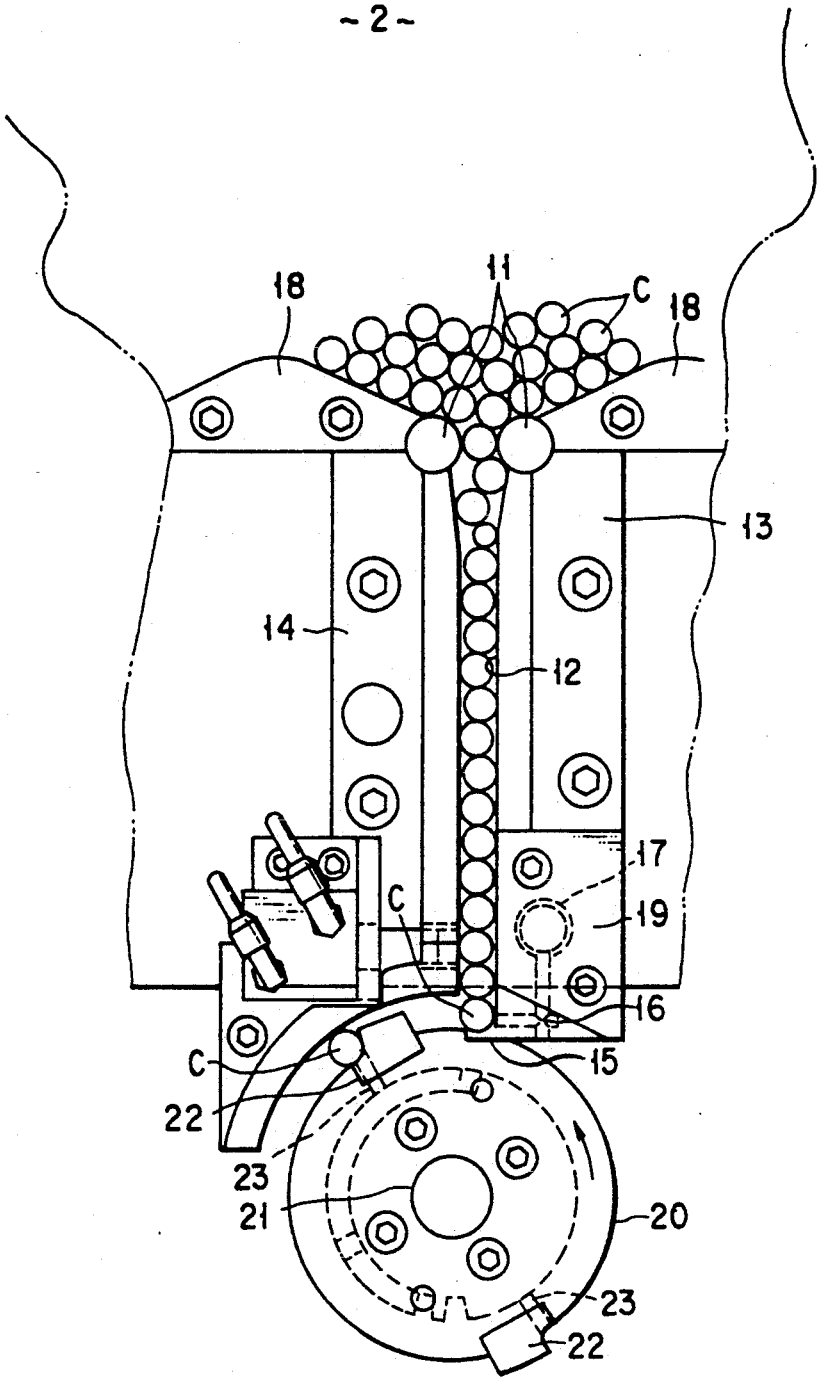
FIG. 4 is an enlarged partial front view of the piling machine of FIG. 2.

As seen from FIGS. 2 and 4, a receiving drum 20 is arranged under the lower end of each of the feed channels 12. The receiving drum 20 rotates around an axis of rotation 21 in the sense as indicated by an arrow in FIG. 4 and is provided on the outer peripheral surface with a number of, e.g., two, receiving members 22, each having a rounded groove on its front surface for receiving and holding a cigarette C. The rounded groove is also provided with an open end of a negative pressure nozzle 23.

Thus, the cigarette C held by the flange 15 at the lower end of each of the feed channels 12 is taken up by one of the receiving members 22 of the receiving drum 20 as the latter rotates and held in its rounded groove by the sucking effect of the negative pressure supplied by the negative pressure nozzle 23.

As illustrated in FIG. 2, the twenty receiving drums 20 for twenty feed channels 12 are divided into three groups of seven, six and seven and the receiving drums of each of the groups are arranged around an aligning drum 30 so that there are a total of three aligning drums 30 provided for handling cigarettes coming from the twenty feed channels. Each of the aligning drums 30 rotates around an axis of rotation 31 in the sense as indicated by an arrow in FIG. 4 at a peripheral speed equal to that of the receiving drums for which it is responsible. Each of the aligning drums 30 is provided on its peripheral surface with a plurality of groups of alignment grooves 32, the number of alignment grooves 32 of each group being seven or six, or the numbers of cigarettes arranged in rows for packaging. When each of the groups of alignment grooves of an aligning drum passes under the receiving drums 20 for which it is responsible, it receives from the receiving drums 20 cigarettes C, the number of which is of course equal to the number of alignment grooves 32. Note that each of the alignment grooves 32 is provided with an open end of a negative pressure nozzle for holding the cigarette C in the groove for a certain period of time.

Figure 5:
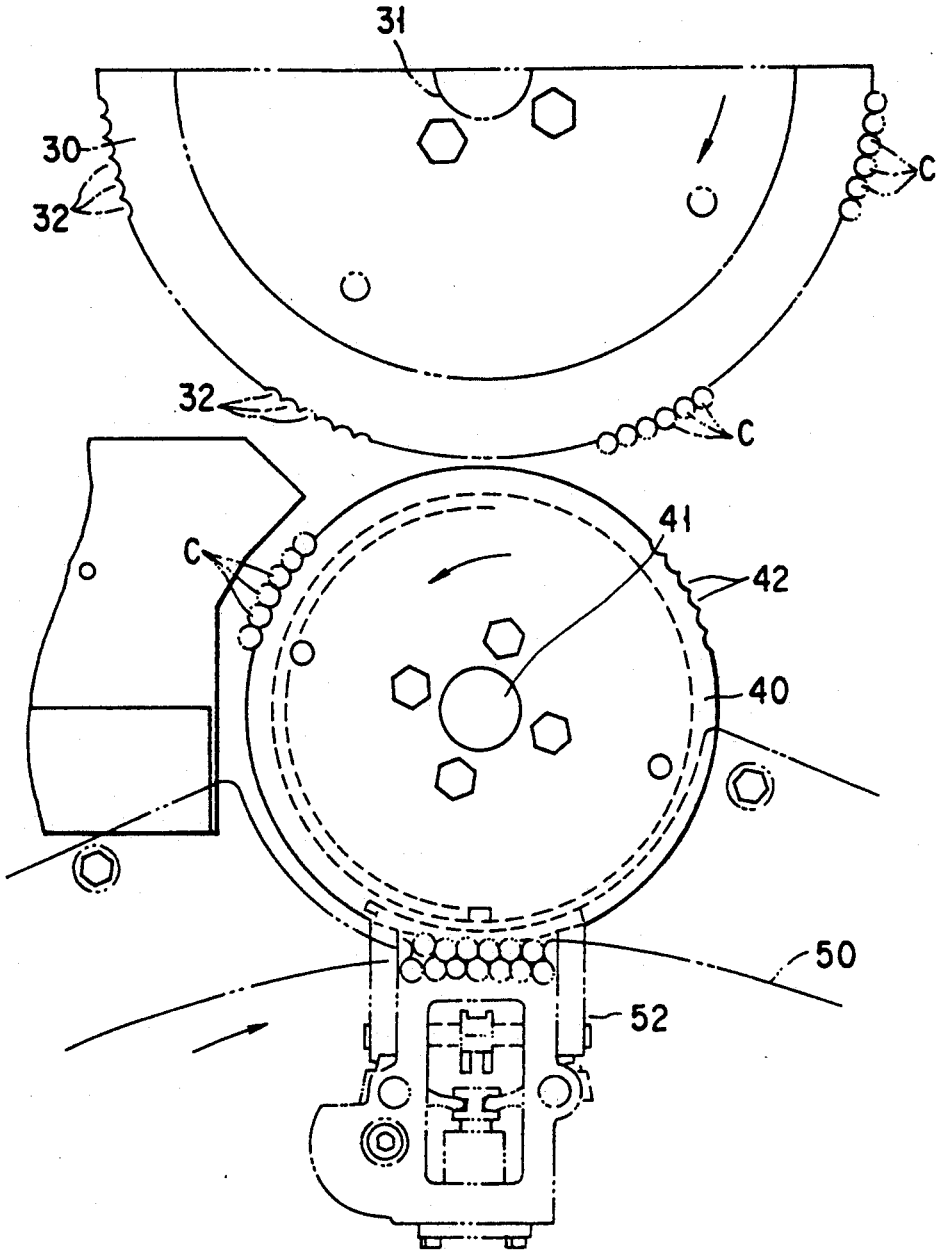
FIG. 5 is an enlarged partial front view of one of the transferring drums of the piling machine of FIG. 2.
Figure 6:
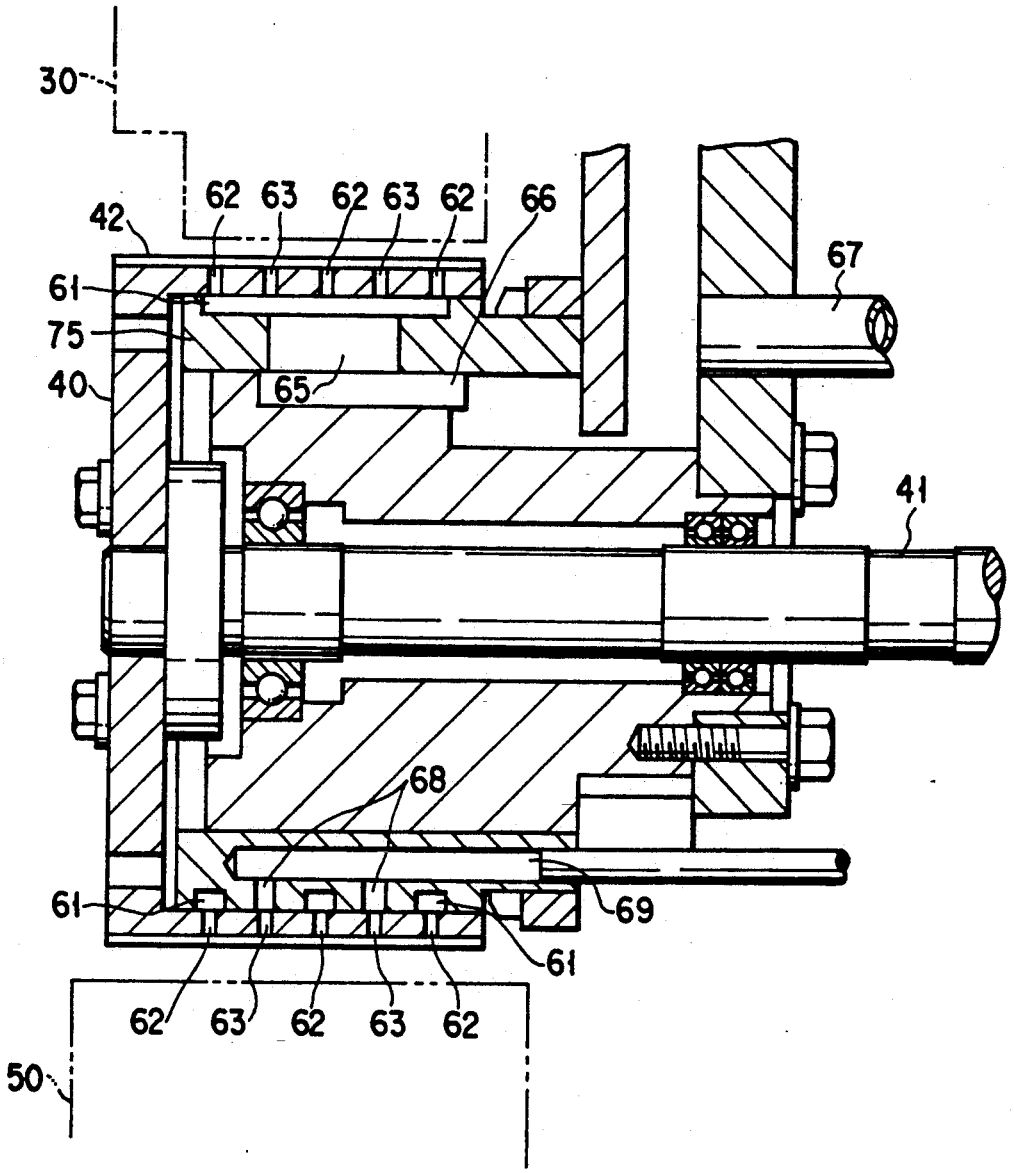
FIG. 6 is a longitudinal sectional view of the transferring drum of FIG. 5.

As seen from FIGS. 2 and 5, a transferring drum 40 of a cigarette ejecting system according to the invention is arranged vis-a-vis each of the aligning drums 30. Therefore, the embodiment of the cigarette ejecting system of the present invention comprises a total of three transferring drums 40. Each of these transferring drums 40 rotates around an axis of rotation 41 in the sense as indicated by an arrow in FIG. 5 and is provided on its peripheral surface with a plurality of groups of holding grooves 42, each of the holding grooves 42 being also provided with an open end of a negative pressure nozzle for holding a cigarette C. The cigarettes C held in a group of alignment grooves 32 of each of the aligning drums 30 for a row of cigarettes are transferred to the respective holding grooves 42 of the corresponding transferring drum 40. As seen again from FIGS. 2 and 5, a single piling drum 50 is arranged for the three transferring drums 40 for piling three row of cigarettes it receives from these transferring drums 40. The piling drum 50 rotates around an axis of rotation 50 in the sense as indicated by an arrow in FIG. 5 and is provided on its peripheral surface with a plurality of heads 52, each of which receives a row of cigarettes as it passes under one of the transferring drums 40 so that three rows of cigarettes are piled up in the head in an orderly and staggered manner when the head has passed under all the transferring drums 40.

Figure 3:
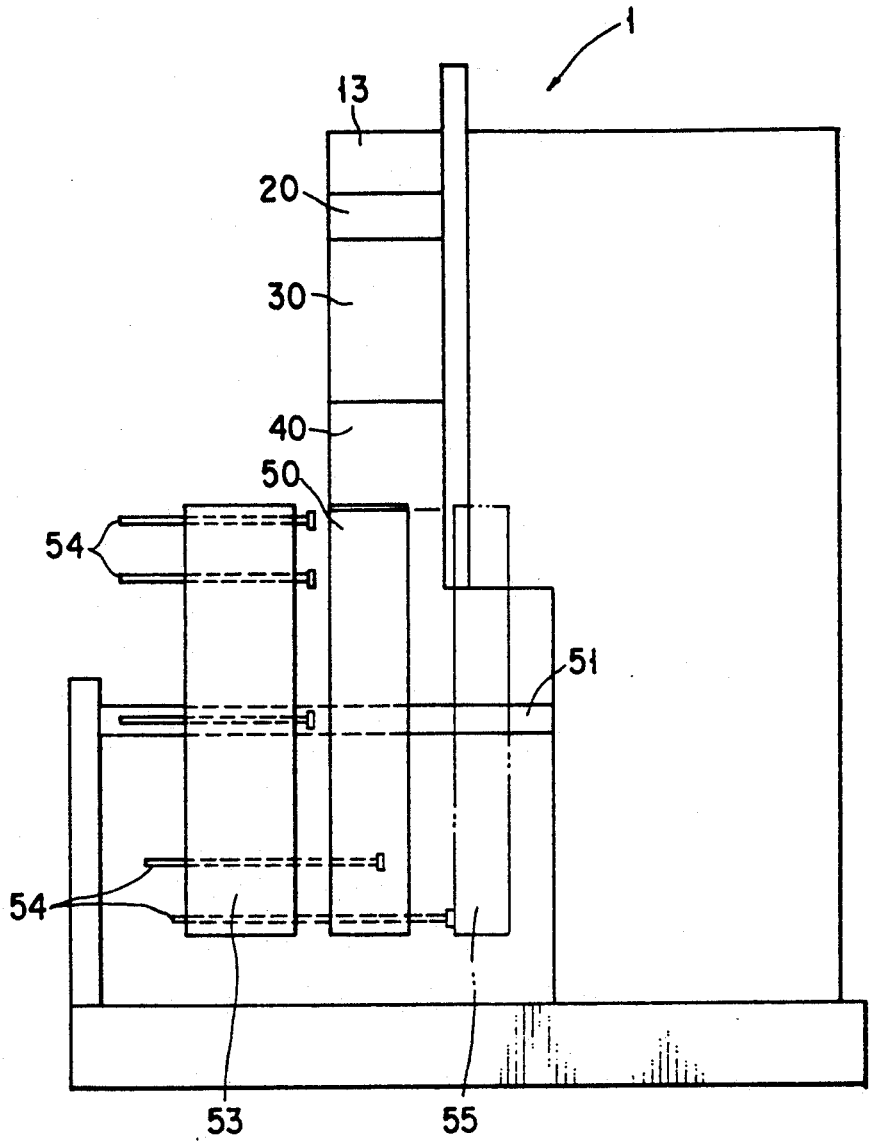
FIG. 3 is a side view of the piling machine of FIG. 2.

As illustrated in FIG. 3, said axis 51 also carries a pushing drum 53 which rotates synchronously with said piling drum 50. The pushing drum 53 carries a number of pushers 54 arranged vis-a-vis the corresponding respective heads of the drum 50 to push the twenty cigarettes C held in each of the heads 52 into a transferring drum 55. The twenty cigarettes arranged in three rows are then wrapped in a sheet of aluminum foil or wrapping paper by the wrapping machine 3 illustrated in FIG. 1 and sealed by the sealing machine 4.

Now, the embodiment of the cigarette ejecting system of the invention will be described in greater detail by referring to FIGS. 5 through 8. As seen from FIG. 6, each of the transferring drums 40 is in the form of a cylinder and provided on its outer peripheral surface with a number of groups of holding grooves 42, which are provided at the bottoms with a set of open ends of a number of suction nozzles 62 and that of a number of ejection nozzles 63. The opposite ends of the suction nozzles 62 and those of the ejection nozzles 63 are found on the inner peripheral surface of the transferring drum 40. The suction nozzles 62 and the ejection nozzles 63 of the embodiment are substantially identical in terms of shape and dimensions but are arranged at different locations. In this embodiment, the suction nozzles 62 and the ejection nozzles 63 are arranged in parallel with one another in an alternating manner along the axial direction of the transferring drum 40.

Figure 7:
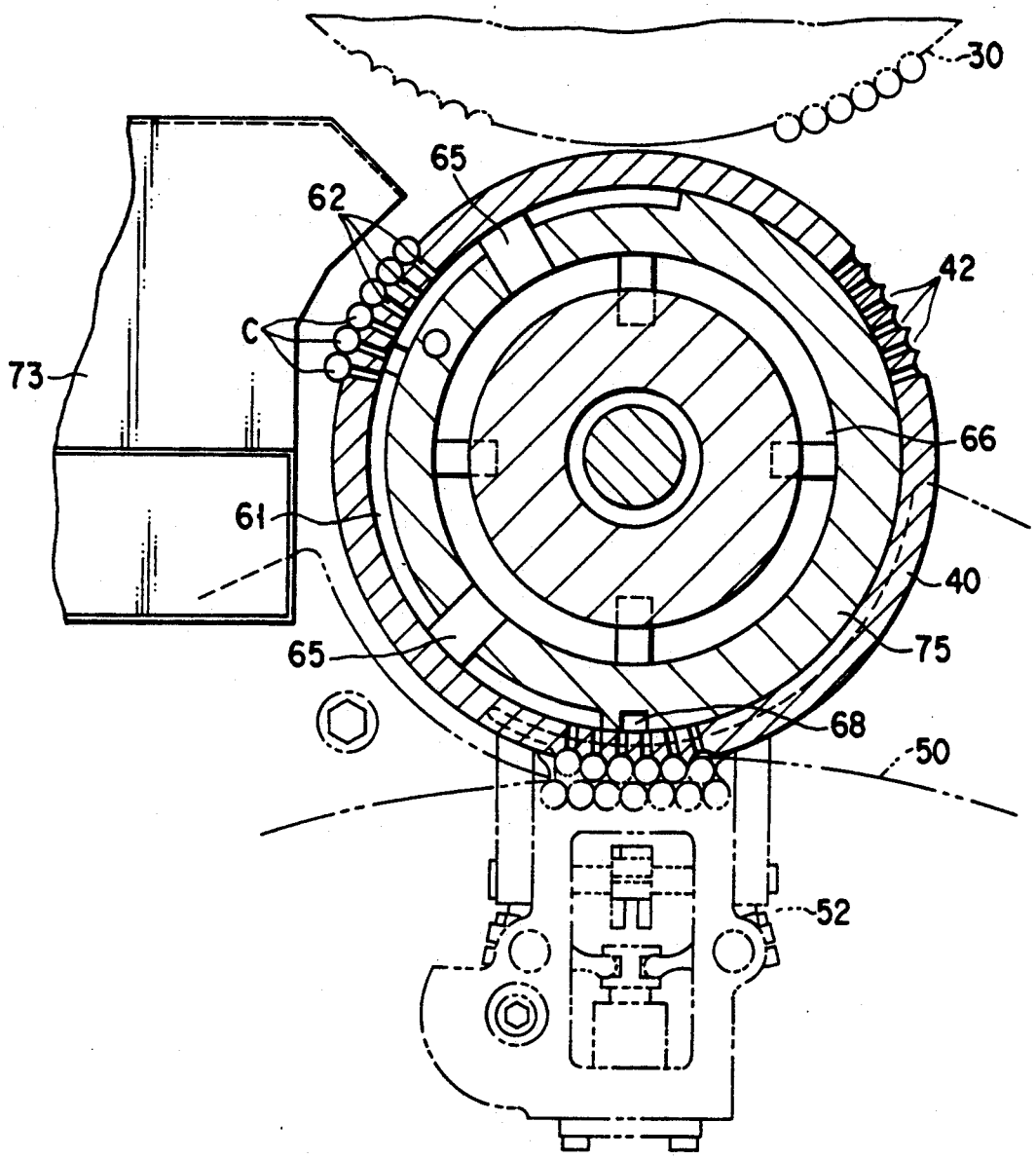
FIG. 7 is a lateral sectional view of the transferring drum of FIG. 5 cut along the suction nozzles of the drum.

A stationary sleeve 75 is fitted to the inner peripheral wall of each of the transferring drums 40 with a narrow clearance provided therebetween so that the transferring drum 40 is rotatable while maintaining an airtight condition in the inside. The stationary sleeve 75 is provided on its outer peripheral surface with a suction groove 61, which is in communication with a negative pressure source such as a negative pressure pump of a known type by way of pathways 65, 66 and a negative pressure piping 67. The suction groove 61 is arranged vis-a-vis and in communication with the suction nozzles 62. As shown in FIG. 7, the suction groove 61 extends on the outer peripheral surface of the stationary sleeve 75 over a half of its perimeter from the vicinity of the alignment drum 30 to that of the piling drum 50. Thus, each of the suction nozzles 62 is under negative pressure supplied there by way of the suction groove 61 from the time when it receives cigarettes from the corresponding aligning drum to the time when it discharges the cigarettes to the piling drum 50 so that it can effectively keep the cigarettes in the holding grooves 42.

The stationary sleeve 75 is also provided on its outer peripheral surface and near the piling drum 50 with releasing grooves 68, which communicate with the ejection nozzles 63. Compressed air is supplied to the releasing grooves 68 by way of high pressure pathways 69. Thus, when the holding grooves 42 with cigarettes held there reach the respective releasing grooves 68, they are exposed to the compressed air blown through the ejection nozzles 63 and forcedly release the respective cigarettes into the corresponding head 52 of the piling drum 50.

Figure 8:
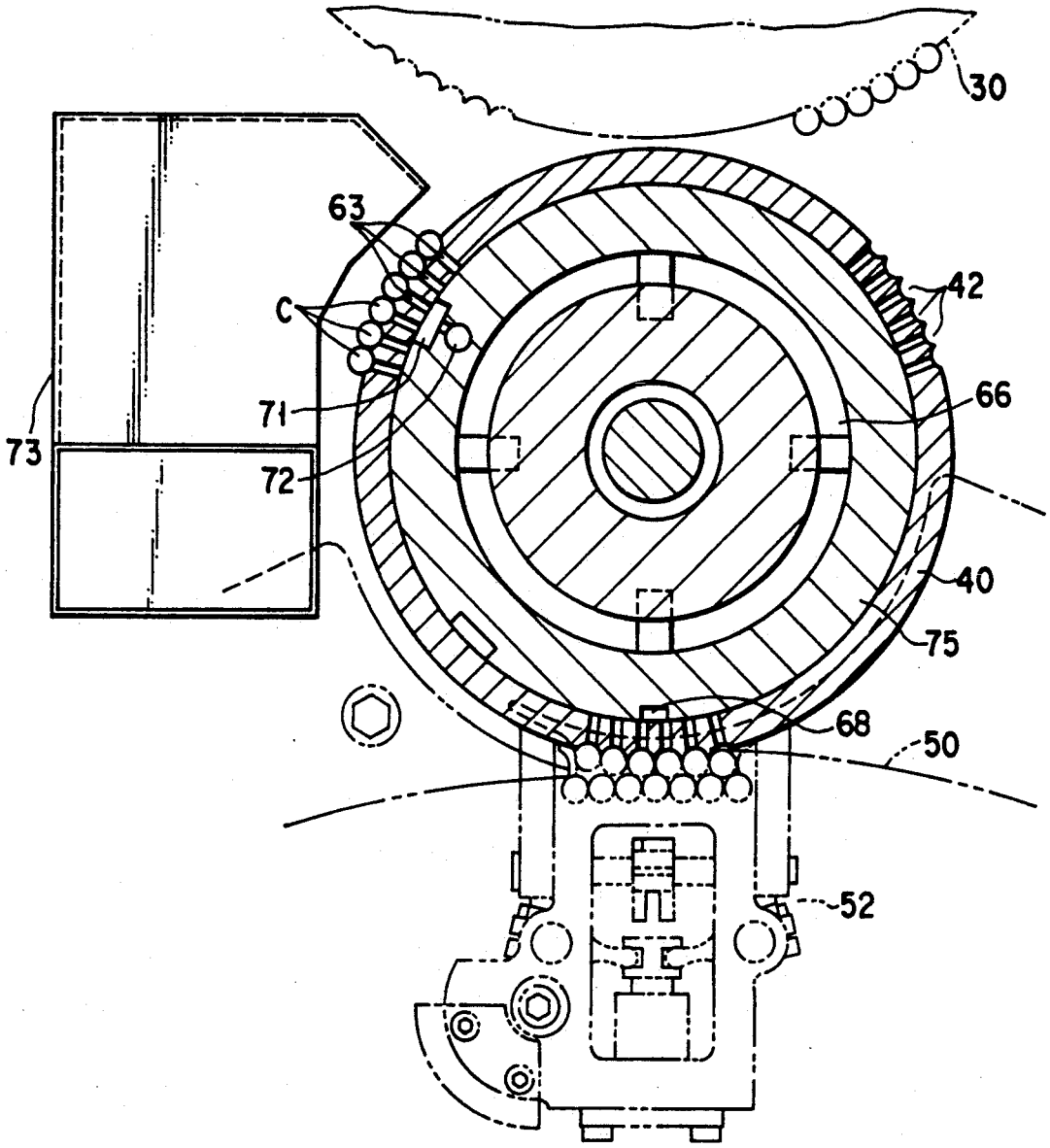
FIG. 8 is a lateral sectional view of the transferring drum of FIG. 5 cut along the ejection nozzles of the drum.

A receiving shoot 73 is arranged near each of the transferring drums 40 for receiving, whenever necessary, all the cigarettes of a row that has one or more than one defective cigarettes or that does not have a correct number of cigarettes. The stationary sleeve 75 is provided near the outer peripheral surface and the receiving shoot 73 with an ejection groove 71 as illustrated in FIG. 8.

The ejection groove 71 communicates with the ejection nozzles 63 and a pathway of compressed air 72. The pathway of compressed air 72 is, by turn in communication with a source of compressed air of a known type such as an air compressor by way of a solenoid valve of a known type. The solenoid valve opens itself whenever it receives a signal from a defective cigarette detector (not shown).

As long as no defective cigarette is detected in the cigarettes transferred from the aligning drums 30 to the respective transferring drums 40, no compressed air is supplied to the ejection groove 71 and, therefore, the cigarettes are transferred in rows to a corresponding head 52 of the piling drum 50.

When one or more than one defective cigarettes such as a cigarette having a defective filter are detected in the cigarettes located on the transferring drums 40 by the detector of a known type, a signal is transmitted to the solenoid valve, which in turn opens itself to allow compressed air into the ejection groove 71. The compressed air bursts forth through the ejection nozzles 63 to eject the cigarettes C held there into the receiving shoot 73.

As is apparent from the above description, since defective cigarettes on the transferring drums are ejected therefrom by compressed air, the operation of ejecting and removing defective cigarettes is not subjected to any limit of operating speed and, therefore, an ejecting system according to the invention can accommodate any high speed operation of a cigarette packaging apparatus that incorporates it. Moreover, since defective cigarettes are removed before being packaged, the tobacco of those cigarettes can be resued without causing any additional problem.

Additional advantages and modifications will readily occur to those skilled in the art. Therefore, the invention in its broader aspects is not limited to the specific details, and representative devices, and shown and described herein. Accordingly, various modifications may be made without departing from the spirit or scope of the general inventive concept as defined by the appended claims and their equivalents.

What is claimed is:

1. A cigarette ejecting device to be incorporated in a cigarette packaging apparatus comprising a piling machine for arranging a plurality of cigarettes in rows and piling the rows of cigarettes to layers in an orderly and staggered manner and a wrapping machine for wrapping the layers of cigarettes, wherein said ejecting system is constituted by:

that said piling machine comprises a plurality of aligning drums, each for aligning cigarettes in a row, and a piling drum for receiving a row of cigarettes from each of the aligning drums and piling the rows of cigarettes to layers in an orderly and staggered manner;

that said device comprises a plurality of transferring drums, each being a hollow cylinder having an outer peripheral surface and an inner peripheral surface, said transferring drums being disposed between the respective aligning drums and the piling drum for receiving from the corresponding aligning drum a row of cigarettes and forwarding the cigarettes to said piling drum, each of said transferring drums being provided on an outer peripheral surface thereof with a plurality of cigarette holding grooves for receiving and holding a row of cigarettes;

that each of said transferring drums is provided with suction nozzles and ejection nozzles, each having an open end on one of said holding grooves and the other open end on the inner peripheral surface of the transferring drum; and that a stationary sleeve is fitted to the inner peripheral wall of each of the transferring drums with a narrow clearance provided therebetween, said stationary sleeve being provided on an outer peripheral surface thereof with a suction groove and an ejection groove, said suction groove being connected to a negative pressure source and in communication with said suction nozzles for sucking and holding the cigarettes arranged on said holding grooves by negative pressure, said ejection groove being in communication with said ejection nozzles for supplying compressed air to said ejection groove so that the cigarettes held to said holding grooves are ejected when compressed air is forced through the ejection nozzles.

2. The cigarette ejecting device to be incorporated in a cigarette packaging apparatus according to claim 1, wherein each of said cigarette holding grooves is provided with a plurality of suction nozzles and ejection nozzles, said suction nozzles and ejection nozzles being longitudinally arranged on said holding groove

3. The cigarette ejecting device to be incorporated in a cigarette packaging apparatus according to claim 1, wherein a receiving shoot is disposed close to each of said transferring drums for receiving cigarettes ejected from said drum, said ejection groove being formed on the outer peripheral surface of said stationary sleeve only in the vicinity of said receiving shoot.

* * * * *